US011166554B1

(12) United States Patent
Romero et al.

(10) Patent No.: US 11,166,554 B1
(45) Date of Patent: Nov. 9, 2021

(54) NESTING CHAIR WITH FLIP SEAT AND MOVEMENT

(71) Applicant: Office Master Inc., Ontario, CA (US)

(72) Inventors: Francisco Romero, El Segundo, CA (US); Nadine Romero, El Segundo, CA (US)

(73) Assignee: Office Master Inc., Ontario, CA (US)

( * ) Notice: Subject to any disclaimer, the term of this patent is extended or adjusted under 35 U.S.C. 154(b) by 21 days.

(21) Appl. No.: 16/887,047

(22) Filed: May 29, 2020

(51) Int. Cl.

| | |
|---|---|
| ***A47C 3/04*** | (2006.01) |
| ***A47C 7/56*** | (2006.01) |
| ***A47C 7/58*** | (2006.01) |
| ***A47C 1/024*** | (2006.01) |
| ***A47C 7/00*** | (2006.01) |
| ***A47C 1/121*** | (2006.01) |
| ***A47C 1/03*** | (2006.01) |
| ***A47C 1/032*** | (2006.01) |

(52) U.S. Cl.
CPC ..... *A47C 3/045* (2013.01); *A47C 1/024* (2013.01); *A47C 1/032* (2013.01); *A47C 1/0308* (2018.08); *A47C 1/121* (2013.01); *A47C 7/006* (2013.01); *A47C 7/56* (2013.01); *A47C 7/566* (2013.01); *A47C 7/58* (2013.01)

(58) Field of Classification Search
CPC ..... A47C 3/04; A47C 3/045
USPC ..... 297/239, 313, 331, 332, 335, 336, 341, 297/342, 446.1, 446.2
See application file for complete search history.

(56) References Cited

U.S. PATENT DOCUMENTS

| | | | | |
|---|---|---|---|---|
| 1,104,615 A * | 7/1914 | Braden | A47C 7/56 | 297/332 |
| 1,213,920 A * | 1/1917 | Szymkowiak | A47C 7/56 | 297/332 |
| 3,744,843 A * | 7/1973 | Barecki | B60N 2/3013 | 297/316 |
| 4,749,232 A * | 6/1988 | Guichon | A47C 1/0265 | 297/359 |
| 5,580,127 A | 12/1996 | Piretti | | |
| 6,030,037 A * | 2/2000 | Ritch | A47C 3/04 | 297/239 |
| 6,755,468 B1 * | 6/2004 | Pan | A47C 3/045 | 297/239 |
| 6,935,690 B2 | 8/2005 | Lucci et al. | | |
| 7,296,853 B2 * | 11/2007 | Piretti | A47C 3/04 | 297/239 |

(Continued)

*Primary Examiner* — Robert Canfield
(74) *Attorney, Agent, or Firm* — Andrus Intellectual Property Law, LLP

(57) ABSTRACT

A chair having a separately configured seating assembly and backrest that move together upon reclining movement of a user. The seat assembly can be pivoted between a lowered, seating position and a raised, nesting position. The backrest can be pivoted between an upright position and a reclined position. The seat assembly includes a seat that is movable along seat frame sub-assembly that includes a pair of glide tracks upon the reclining movement of the backrest. A bias member of the seat assembly urges the seat into a retracted position and the backrest into an upright position. The seat assembly is pivotally mounted to the support frame of the chair such that the entire seat assembly can be pivoted to a raised, nesting position. The seat assembly can also be pivoted to a lowered, seating position to allow multiple chairs to be stacked.

18 Claims, 15 Drawing Sheets

(56) References Cited

U.S. PATENT DOCUMENTS

| | | | | |
|---|---|---|---|---|
| 7,717,511 | B2 * | 5/2010 | Huang | A47C 7/54 297/239 |
| 9,144,311 | B2 | 9/2015 | Romero | |
| 9,510,682 | B2 | 12/2016 | Hasegawa et al. | |
| 2005/0264060 | A1 * | 12/2005 | Cesaroni | A47C 3/045 297/239 |
| 2007/0222266 | A1 | 9/2007 | Lucci et al. | |
| 2008/0315645 | A1 * | 12/2008 | Hock | A47C 3/04 297/239 |
| 2010/0194160 | A1 * | 8/2010 | Machael | A47C 3/045 297/239 |
| 2011/0175412 | A1 * | 7/2011 | Piretti | A47C 3/045 297/239 |
| 2015/0282622 | A1 * | 10/2015 | Kumazawa | A47C 3/045 297/335 |
| 2015/0351552 | A1 * | 12/2015 | Brown | A47C 3/045 297/331 |

* cited by examiner

NESTING CHAIR WITH FLIP SEAT AND MOVEMENT

BACKGROUND

The present disclosure generally relates to a chair having a movable seat and a movable backrest. More specifically, the present disclosure relates to a chair in which the backrest and seat are separate components where the seat assembly can be rotated from a lowered, seating position to a raised, nesting position.

Recently, the focus in the seating industry has been to create ergonomic designs that increase the comfort level for the seat occupant. One large aspect of increasing user comfort is to provide a chair that can move between an upright and a reclined position. As an example, U.S. Pat. No. 9,144,311 discloses an embodiment of a chair in which the seat back and seating assembly are movable to increase comfort for the seat occupant. Although this reference discloses a chair having integrated movement between the backrest and seat assembly, the seat assembly remains in a lowered, seating position at all times.

Presently, a desire exists for a chair that allows for not only the movement of the backrest and the seat assembly between upright and reclined positions but also the ability for the chair to fold into a compact, nesting position. The present disclosure provides a chair that allows the seat assembly and backrest to each move together while also allowing the seat assembly to rotate between a lowered, seating position and a raised, nesting position.

SUMMARY

The present disclosure relates to a chair that includes a backrest and seat assembly that move together while the seat assembly is movable to a raised, nesting position. When the seat assembly is in the lowered, seating position, a seat of the seating assembly is movable between a forward position and a retracted position when the backrest reclines.

The chair includes a support frame having a pair of front legs and a pair of rear legs. The support frame further includes a cross bar that extends between the front legs.

The chair includes a seat assembly that is axially and directionally supported by the support frame. The seat assembly includes a seat and a seat frame sub-assembly, where the seat moves relative to the seat frame sub-assembly. The entire seat assembly is configured to move between a lowered, seating position and a raised, nesting position. In one exemplary embodiment, the seat frame sub-assembly further includes a pair of spaced glide tracks that are supported on the support frame. The seat of the seat assembly is movable along the glide tracks when the seat assembly is in the lowered position.

The chair further includes a backrest that is movable between an upright position and a reclined position. A lower portion of the backrest contacts a rear portion of the seat when the seat assembly is in the lowered position. When the backrest is reclined, the contact between the lower portion of the backrest and the seat causes the seat to move along the glide tracks toward a forward position. In one exemplary embodiment, a bias member, such as a bias spring, is positioned between the seat and the stationary support frame to create a bias force that resists the movement of the seat toward the forward position.

In one exemplary embodiment of the present disclosure, the seat includes a seat glide cover mounted to the rear portion of the seat. The seat glide cover contacts the lower portion of the backrest and is formed from a material different from the material of the seat. The seat glide cover can be removed and replaced from the seat and reduces the noise created during the movement of the backrest.

The seat frame sub-assembly further includes a pair of pivot brackets that provide for the pivoting movement of the seat assembly relative to the support frame. Each of the pivot brackets are connected to one of the glide tracks of the seat frame sub-assembly to entrap the cross bar of the support frame.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Figure 1:
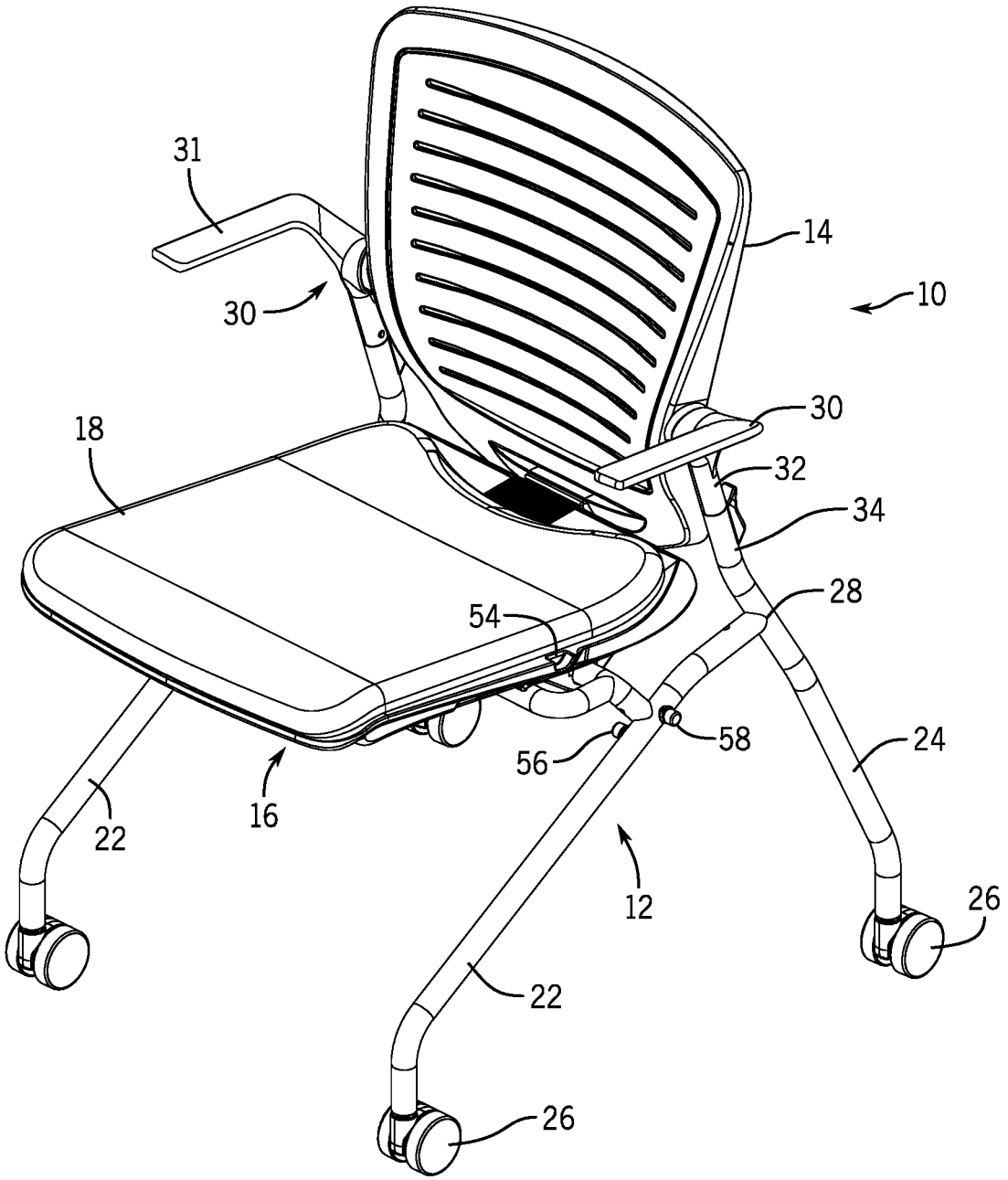
FIG. 1 is front perspective view of a chair constructed in accordance with the present disclosure.
Figure 2:
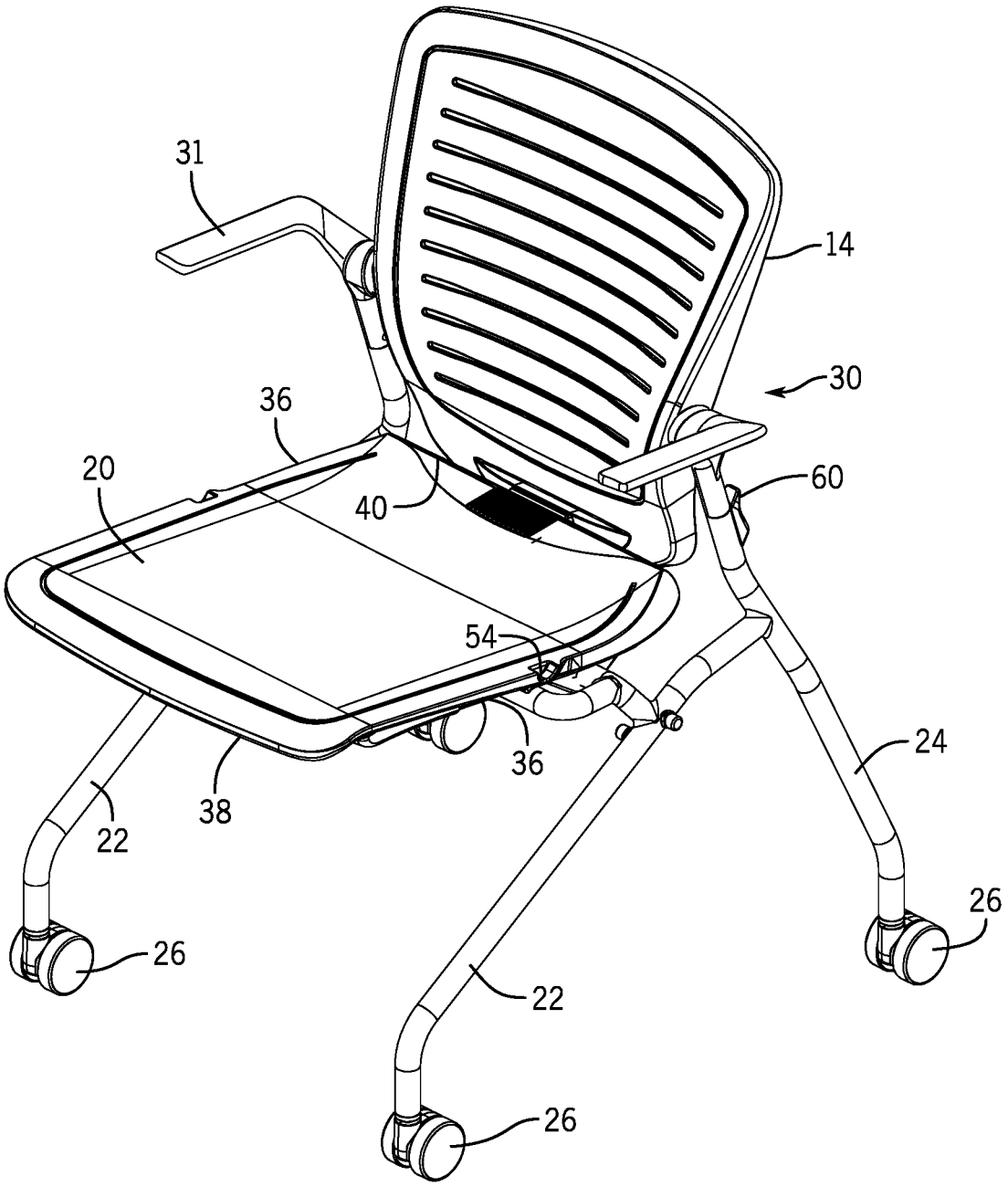
FIG. 2 is a front perspective view of a chair similar to FIG. 1 without a cushion.

FIGS. 1 and 2 illustrate a chair 10 constructed in accordance with the present disclosure. The chair 10 includes a support frame 12 that provides support for a backrest 14 and a seat assembly 16. The seat assembly 16 provides support for a seated occupant while the backrest 14 contacts the back of the seated occupant to provide for comfort when seating. In the embodiment shown in FIG. 1, the seat assembly 16 includes a cushion 18 while the embodiment shown in FIG. 2 does not includes a cushion and instead only includes the molded seat 20.

As illustrated in FIGS. 1 and 2, the support frame 12 includes four legs that include a pair of front legs 22 and a pair of rear legs 24. In the embodiment illustrated, both of the front legs 22 and both of the rear legs 24 include a castor 26 that allows the chair 10 to move along a support surface, such as the floor. As shown in FIG. 1, each of the rear legs 24 is connected to one of the front legs 22 at a junction point 28. The rear legs 24 each extend past the junction point 28 and provides support for one of a pair of arm assemblies 30. Although the arm assemblies 30 shown in the embodiment in the drawing figures each include an arm 31, it should be understood that the arm 31 of each arm assembly 30 could be eliminated while operating within the scope of the present disclosure. Each of the arm assemblies 30 includes a down tube 32 that is received on an upper end 34 of one of the rear legs 24. The down tube 32 securely attaches the arm assembly 30 to one of the rear legs 24. As will be described in greater detail below, the arm assembly 30 provides a pivoting point of connection to the backrest 14 with a pivot assembly that allows the backrest 14 to recline. In the embodiment shown in FIGS. 1 and 2, the seat 20 is formed from a molded plastic material defined by a pair of side edges 36, a front edge 38 formed on a front portion of the seat and a rear edge 40 formed on a rear portion of the seat.

Figure 3:
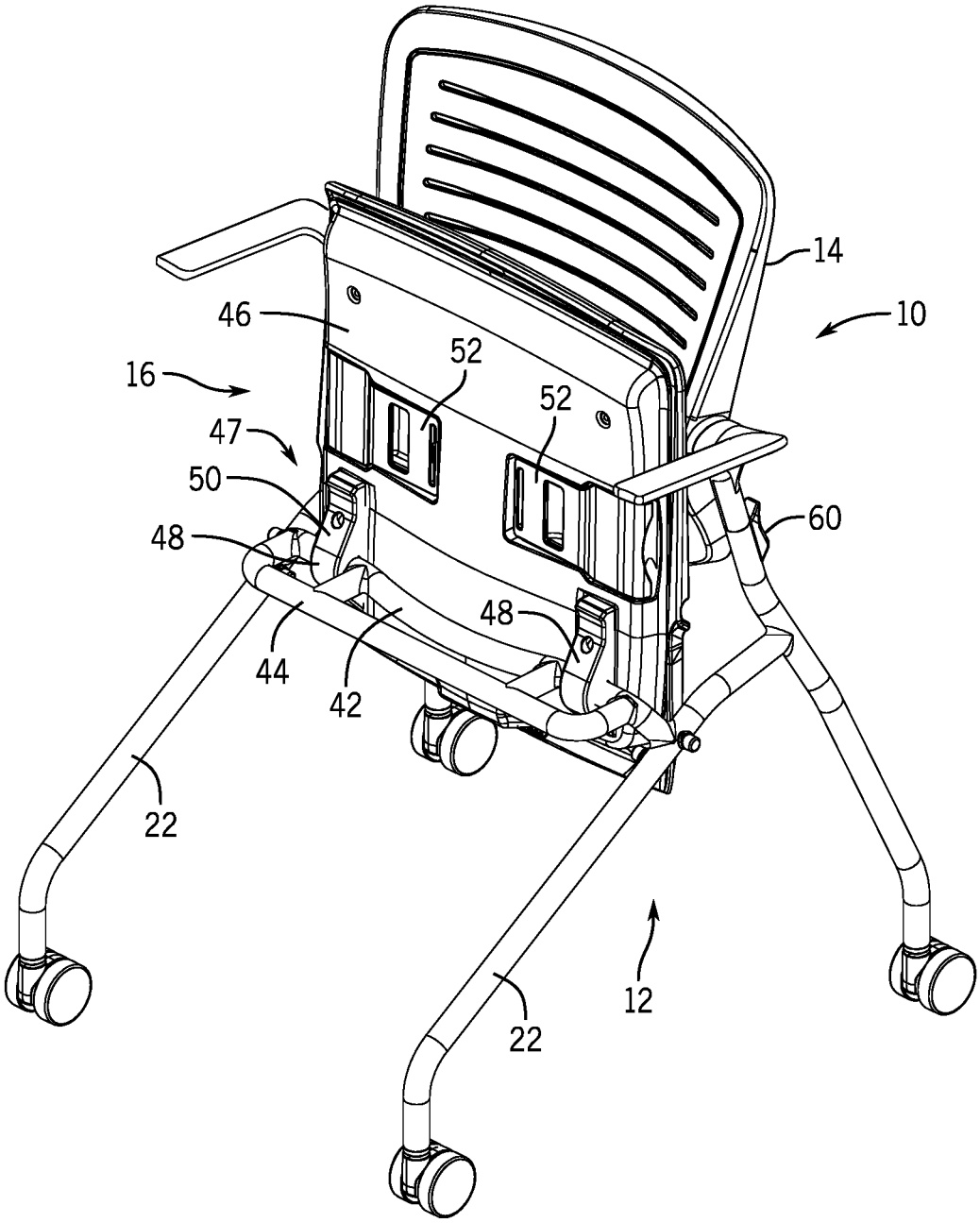
FIG. 3 is a front perspective view of the chair of the present disclosure with the seat assembly in a raised, nesting position.

As can be seen in FIGS. 1 and 3, the entire seat assembly 16 can pivot from the lowered, seating position shown in FIG. 1 to the raised, nesting position shown in FIG. 3. When the seat assembly 16 is in the raised, nesting position of FIG. 3, the entire chair 10 is in a nesting condition in which multiple chairs can be nested next to each other in a manner as shown in FIG. 21. In the nesting condition shown in FIG. 21, five separate chairs are shown, however there can be any number of chairs placed in close relation to each other to reduce the amount of space needed to store a series of chairs. As can be understood in FIGS. 7 and 20, rear legs 24 are spaced further apart than the front legs 22 such that the front legs 22 of one chair can be received between the back legs 24 of the chair positioned in front of it.

As illustrated in FIG. 3, the support frame 12 includes a cross bar 42 that extends between the pair of spaced front legs 22. The cross bar 42 is a tubular element that extends across the width of the chair between the front legs 22. The support frame 12 further includes a support bar 44 that is spaced forward from the cross bar 42. Like the cross bar 42, the support bar 44 is a tubular member that provides support for the seat assembly 16 when the seat assembly is in the lowered, seating position shown in FIG. 1.

As illustrated in FIG. 3, the seat assembly 16 includes a seat bottom cover 46. The seat assembly 16 also includes a seat frame sub-assembly 47 that includes a pair of pivot brackets 48 that entrap the cross bar 42 and provide for the pivoting movement of the seat assembly 16. When the cross bar 42 is entrapped by the pivot brackets 48, the seat assembly 16 is able to pivot about the cross bar 42 between the lowered, seating position of FIG. 1 and the raised, nesting position of FIG. 3. When the seat assembly 16 is in the lowered position, the support bar 44 is received within the curved, cradle portion 50 of the pivot bracket 48. In this manner, the pivot brackets 48 allow for both the pivoting movement of the seat assembly 16 and securely supports the seat assembly in the lowered, seating position of FIG. 1.

In the embodiment shown in FIG. 3, the seat bottom cover 46 includes a pair of ganging arms 52 that are each movable between the storage position shown in FIG. 3 and an extended, operative position in which the ganging arms 52 extend laterally past the side edges 36 of the seat 20. When the ganging arms 52 are in the operative position, the ganging arms 52 of adjacent chairs can be used to connect the adjacent chairs and restrict the separation between the chairs. When the pair of ganging arms 52 are in the storage position, such as shown in FIG. 3, each of the chairs can be used in a normal manner without worry of damaging the ganging arms 52.

Figure 22:
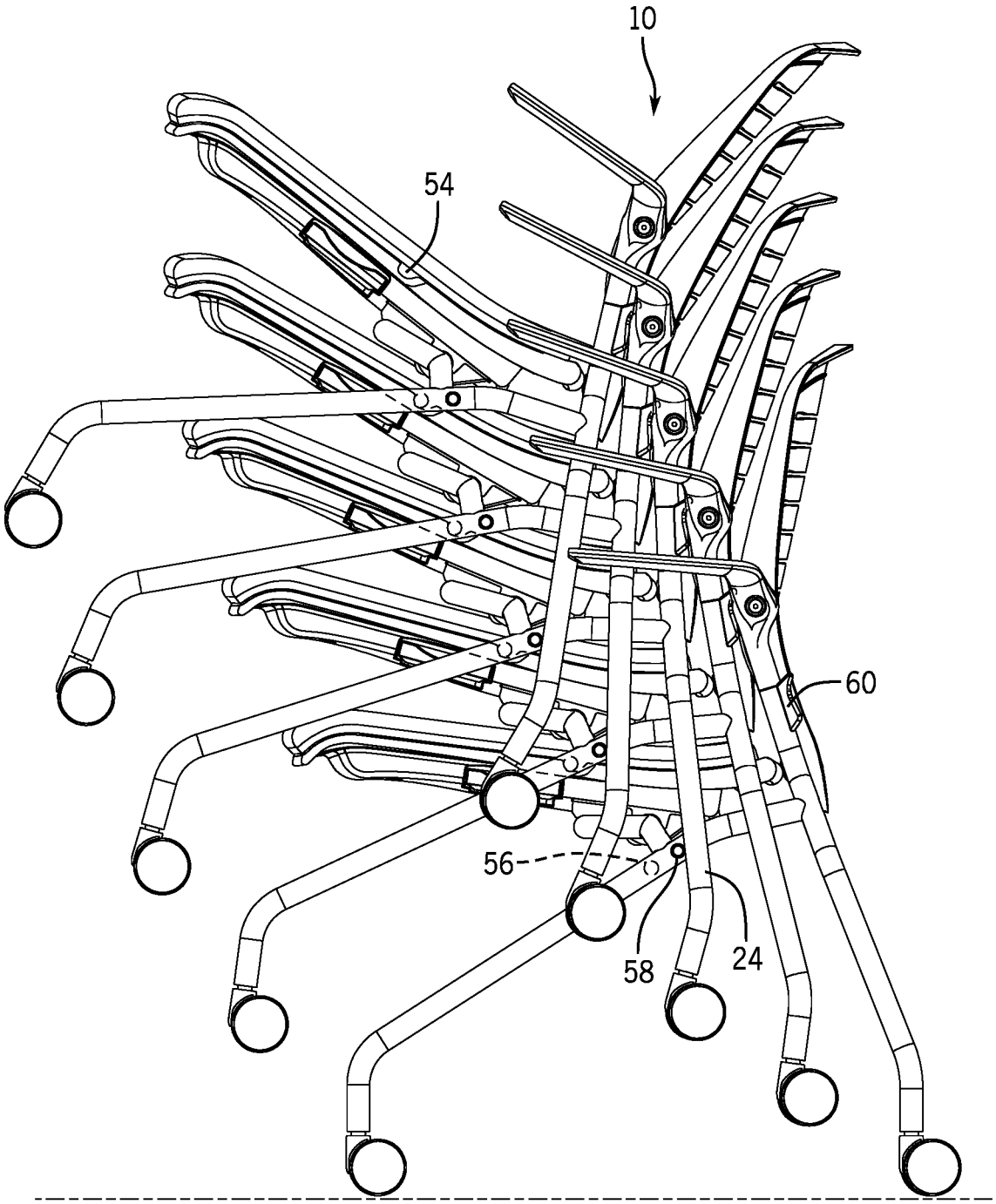
FIG. 22 is a view of multiple chairs in a stacked condition.

As shown in FIGS. 1 and 2, the seat assembly 16 further includes a pair of bumper pockets 54 each formed on each side of the seat. The bumper pockets 54 are designed to receive an inner bumper 56 of another chair when the chairs are stacked on top of each other in the manner shown in FIG. 22. An outer bumper 58 is included on each of the front legs 22 as a contact point for a rear leg 24 of another chair when the chair is nested with another chair. As can be seen in FIGS. 2 and 3, each of the rear legs 24 includes a rear stacking bumper 60 formed from a polypropylene material. As shown in FIG. 22, the rear stacking bumper 60 aids in contacting another chair when the chairs 10 of the present disclosure are stacked on top of each other.

As can be seen in FIG. 22, the chairs 10 of the present disclosure can be stacked on top of each other to reduce the amount of space needed to store the chairs. When stacked as shown, each of the seat assemblies is in the lowered, seating position. Thus, the chairs 10 of the present disclosure can be nested as shown in FIG. 21 or stacked as shown in FIG. 22.

Figure 6:
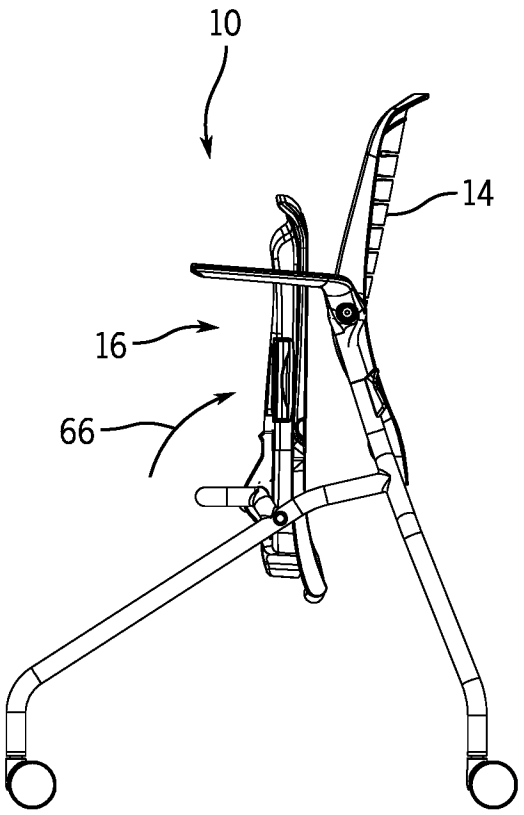
FIG. 6 is a side view of the chair with the seat assembly in the raised, nesting position.
Figure 5:
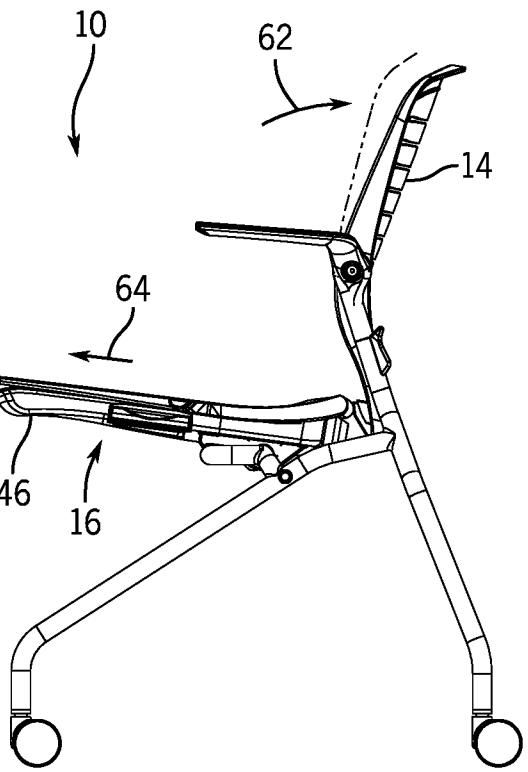
FIG. 5 is a side view of the chair with the seat assembly in the forward position and the backrest in a reclined position.
Figure 4:
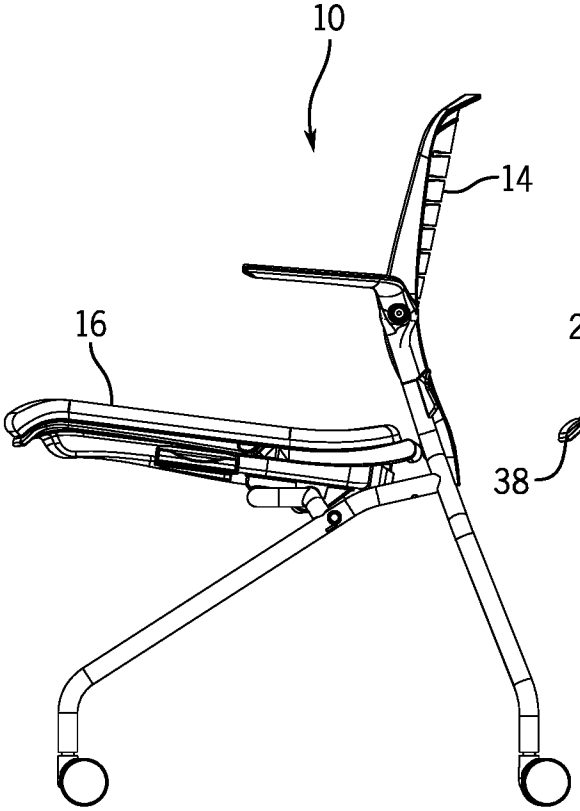
FIG. 4 is a side view with the seat assembly in the retracted position and the backrest in an upright position.

FIGS. 4-6 illustrate the movement possible with the chair 10 constructed in accordance with the present disclosure. In the condition shown in FIG. 4, the backrest 14 is shown in the full upright position and the seat assembly 16 is shown in a lowered, seating position. The condition shown in FIG. 4 is the resting condition for the chair 10 constructed in accordance with the present disclosure.

FIG. 5 illustrates a condition in which a seat occupant leans back into the backrest 14 such that the backrest 14 begins to recline as shown by arrow 62. As the backrest 14 begins to move to the reclined position, the seat 20 of the seat assembly 16 moves from the retracted position shown in FIG. 4 to a forward position. Specifically, the movement occurs by the seat 20 moving relative to the seat bottom cover 46, as illustrated by arrow 64. As can be seen in FIG. 5, the front edge 38 of the seat 20 moves away from the stationary seat bottom cover 46. The forward movement of the seat 20 is caused by the interaction between a bottom portion of the backrest 14 and a rear portion of the seat 20.

In addition to the movement shown in FIG. 5, the chair 10 also permits the entire seat assembly 16 to pivot from the lowered, seating position shown in FIG. 4 to the raised, nesting position shown in FIG. 6. The pivoting movement of the entire seat assembly is shown by arrow 66 in FIG. 6. As was described previously, the pivoting movement of the seat assembly 16 allows the chair to enter into the nesting position shown in FIG. 6. Thus, as can be understood in FIGS. 4-6, the chair 10 allows the backrest 14 to recline between an upright position and a reclined position while the seat moves from a retracted position to a forward position. In addition, the chair also allows the entire seat assembly 16 to pivot from a lowered, seating position to a raised, nesting position.

Figure 7:
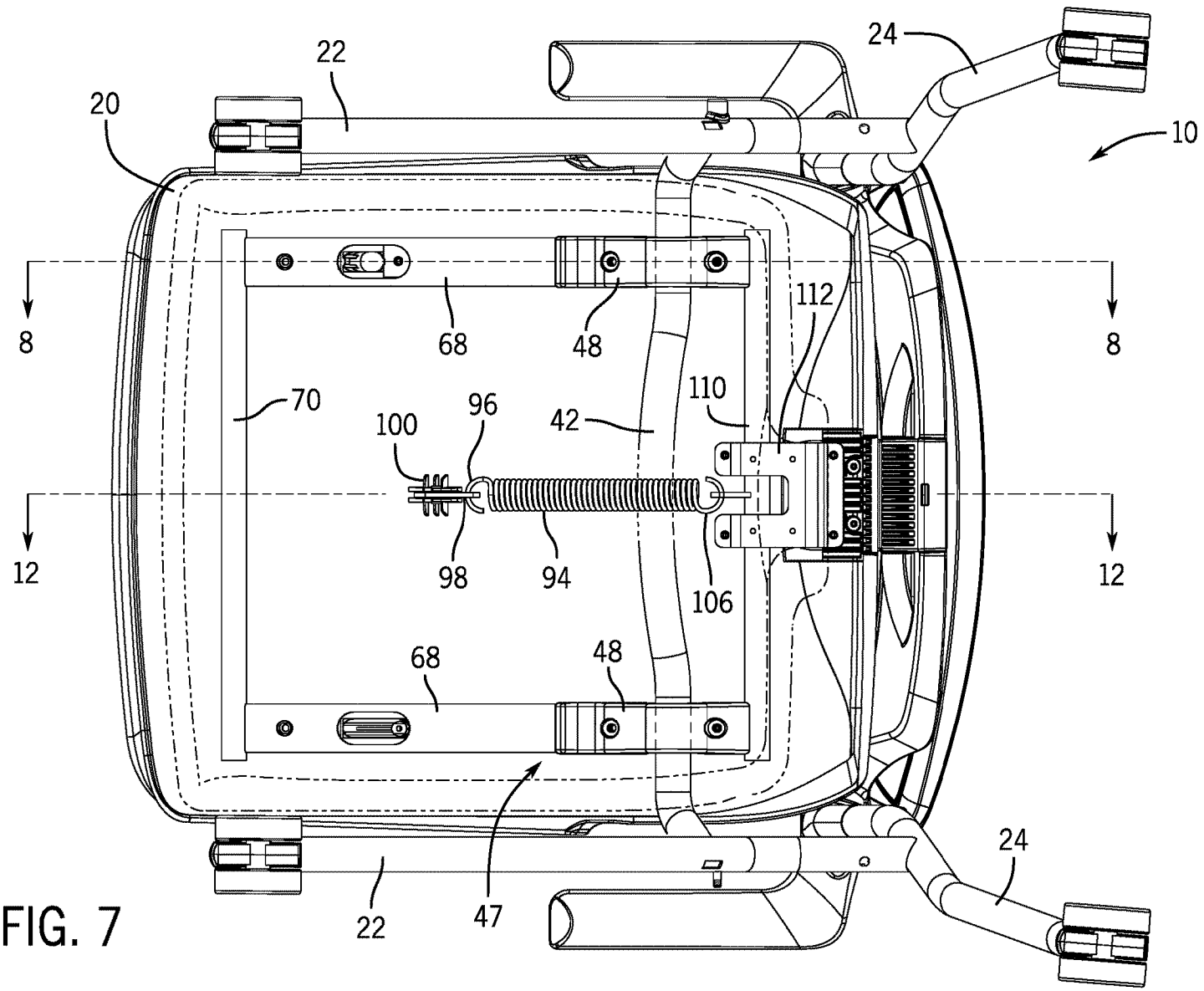
FIG. 7 is a bottom view of the chair with the seat bottom cover removed.

FIG. 7 is a bottom view of the chair 10 in which the seat bottom cover has been removed to show the bottom surface of the seat 20. As indicated previously, the chair 10 includes a seat frame sub-assembly 47 that includes a pair of pivot brackets 48 that entrap the cross bar 42. The pivot brackets 48 allow the entire seat assembly to pivot about the cross bar 42.

As illustrated in FIG. 7, each of the pair of pivot brackets 48 are securely connected to the glide tracks 68 of the seat frame sub-assembly 47. The glide tracks 68 are joined to each other by a front cross bar 70 and a rear cross bar 110 that are each formed from a metallic material. As shown in the cross section view of FIG. 8, each of the glide tracks 68 includes an upper sliding surface 72. The upper sliding surface 72 includes an open slot 74 that provides access to the open interior of the glide track. The front and rear end of each glide track 68 is securely connected to the front and rear cross bars 70 and 110 through a weldment at each location.

Figures 8, 9:
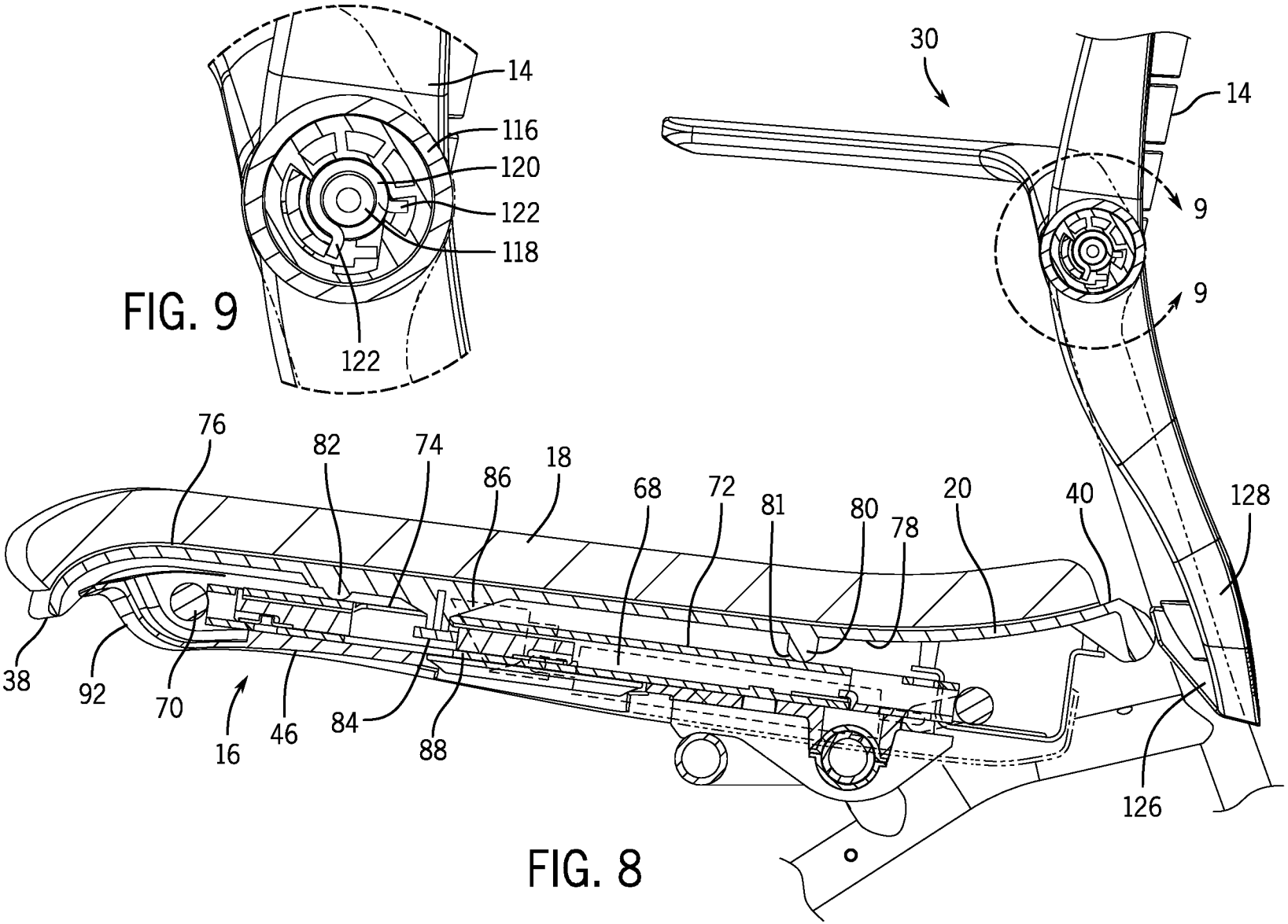
FIG. 8 is a section view taken along line 8-8 of FIG. 7.
FIG. 9 is a magnified view of the area shown by line 9-9 in FIG. 8.

As illustrated in FIG. 8, the seat 20 is a molded plastic component that extends from the rear edge 40 to the front edge 38 and supports the cushion 18 on its upper surface 76. The rear surface 78 of the seat 20 includes a rear glide 80 and a front glide 82 that are each co-molded with the remaining portions of the seat 20. The front and rear glides 80, 82 each include a curved contact surface 81 that is designed to slide along the upper sliding surface 72 as the seat moves from the retracted position shown in FIG. 8 to the extended position shown in FIG. 10.

In addition to the pair of glides, the rear surface 78 of the seat 20 also includes a stop member 84 that is received within an extended mounting portion 86. The stop member 84 extends away from the back surface of the seat and into the open slot 74 formed in the glide track 68. The stop member 84 provides stop points for both the forward position of the seat 20 shown in FIG. 10 and the retracted position of the seat shown in FIG. 8.

Figures 10, 11:
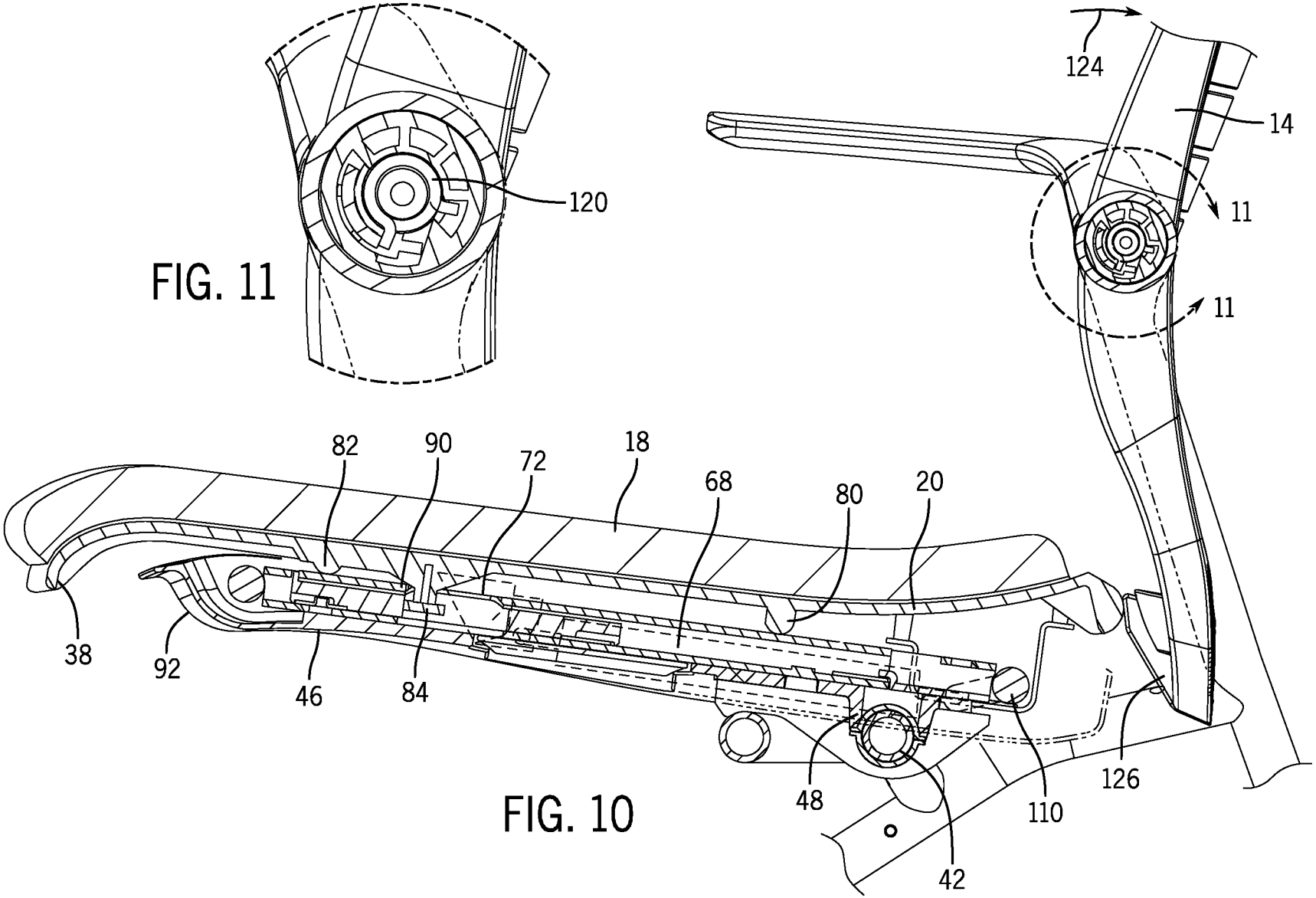
FIG. 10 is a section view similar to FIG. 8 with the backrest rotated to the reclined position and the seat moved to the forward position.
FIG. 11 is a magnified view taken along line 11-11 of FIG. 10.

As illustrated in FIG. 8, the stop member 84 contacts a rear edge 88 of the open slot 74 to limit the rearward movement of the seat. In FIG. 10, the stop member 84 is shown in contact with a front edge 90 of the open slot 74 to limit the movement of the seat 20 to the forward position shown in FIG. 10. As can be understood in FIG. 10, when the seat 20 is in the forward position, the front edge 38 of the seat 20 extends well past the front edge 92 of the seat bottom cover 46 while in the retracted position shown in FIG. 8, the front edge 38 of the seat 20 is positioned in close spacing to the front edge 92 of the seat bottom cover 46. In one embodiment of the disclosure, the open slot 74 includes a front and rear urethane stop pads. The purpose of these stop pads is to both act as a stop and to dampen the sound when contact is made at rest and recline through the stop member 84.

As can be understood in the views shown in FIGS. 8 and 10, the seat 20 is freely movable relative to the seat bottom cover 46 and the pair of glide tracks 68 of the seat frame sub-assembly 47. Since the glide tracks 68 are each mounted to one of the pivot brackets 48 of the seat frame sub-assembly 47, the glide tracks 68 do not move laterally and remain stationary relative to the cross bar 42. In this manner, the seat 20 is able to move laterally with respect to the glide tracks 68 and the seat frame sub-assembly 47 when the seat assembly is in the lowered, seating position.

Figure 12:
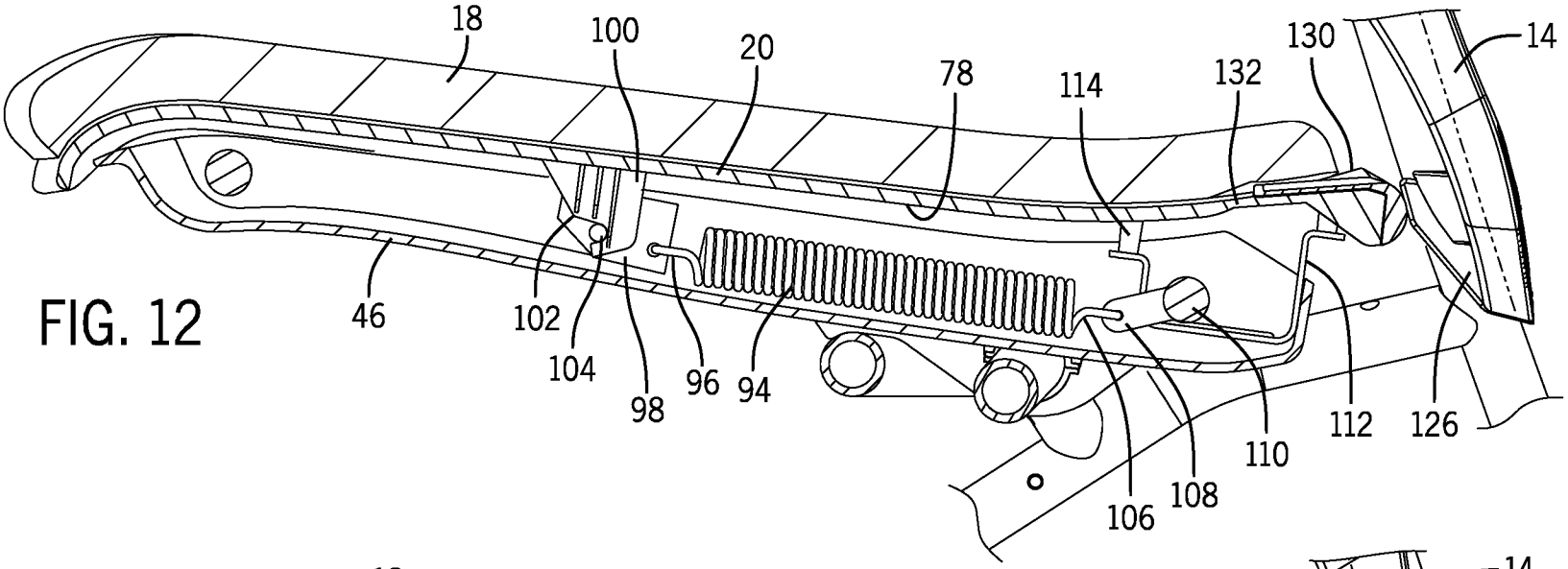
FIG. 12 is a section view taken along line 12-12 of FIG. 7.
Figure 13:
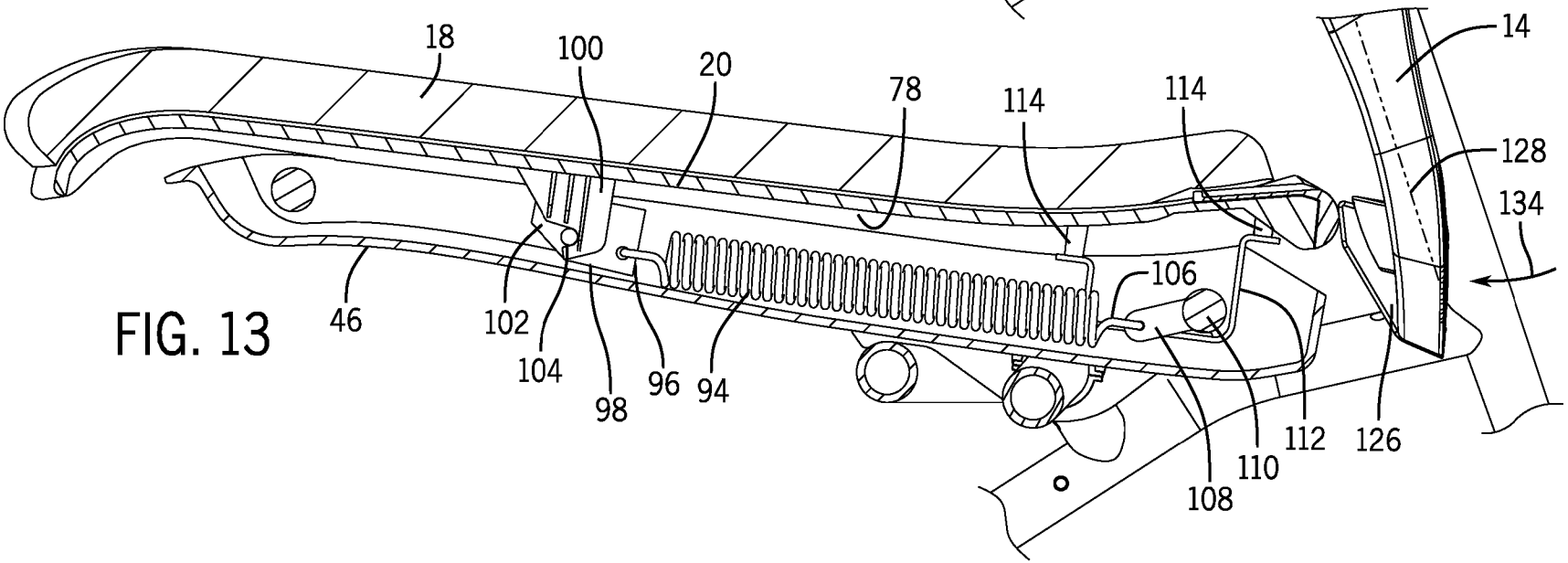
FIG. 13 is a section view similar to FIG. 12 with the seat moved to the forward position and the backrest rotated to a reclined position.

Referring back to FIG. 7, a bias member, such as the bias spring 94, is included as part of the seat assembly. The bias spring 94 has a first end 96 connected to an attachment tab 98, which in turn is supported by a rib feature 100 that is an integral part of the seat 20. The rib feature 100 extends from the bottom surface 78 of the seat 20, as best shown in FIGS. 7 and 12-13. The rib feature 100 is preferably co-molded with the rest of the seat 20 and extends below the bottom surface 78. The rib feature 100 is located between the pair of spaced guide tracks and includes a recessed receiving slot 102 that allows the rib feature 100 to be connected to the attachment tab 98 utilizing an attachment pin 104.

The second end 106 of the bias spring 94 is connected to a bracket 108 which in turn is supported by a rear cross brace 110. The rear cross brace 110 extends between the pair of spaced glide tracks 68, as shown in FIG. 7. Since the cross brace 110 is connected to the glide tracks 68, the second end 106 of the bias spring 94 is stationary such that the bias spring 94 creates a bias force to resist the lateral forward movement of the seat 20.

As best illustrated in FIGS. 7 and 12-13, a support bracket 112 is connected to a pair of mounting posts 114 that extend from the bottom surface 78 of the seat 20. The support bracket 112 is formed from a metallic material. As illustrated in FIGS. 12 and 13, the support bracket 112 moves with the seat 20 when the seat moves from the retracted position shown in FIG. 12 to the extended position shown in FIG. 13. The support bracket 112 prevents the rear portion of the seat from lifting up off the glide tracks 68. During this movement, the length of the bias spring 94 extends to help resist the movement of the seat and backrest.

In addition to the bias force created by the bias spring 94, the backrest is also biased into the upright position shown in FIG. 8. When the backrest 14 is in the upright position, the seat assembly 16 is in the retracted position. As illustrated in FIG. 9, the backrest 14 includes an outer hub 116 that is integrally formed with the plastic material used to form the backrest 14. The outer hub 116 defines a hollow circular volume that receives the arm assembly 30 connected to one of the rear legs 24. The arm assembly includes a pivot pin 118 and a torsion spring 120. The torsion spring 120 has a pair of ends 122. The torsion spring 120 provides a bias force that urges the backrest into the upright position shown in FIG. 8.

When a user desires to recline, the user exerts a rearward force on the backrest 14, thereby causing the backrest to move into a reclined position, as shown by arrow 124 in FIG. 10. During this rearward movement, the torsion spring 120 flexes to allow the pivoting movement of the backrest relative to the stationary arm assemblies and rear legs.

Figure 19:
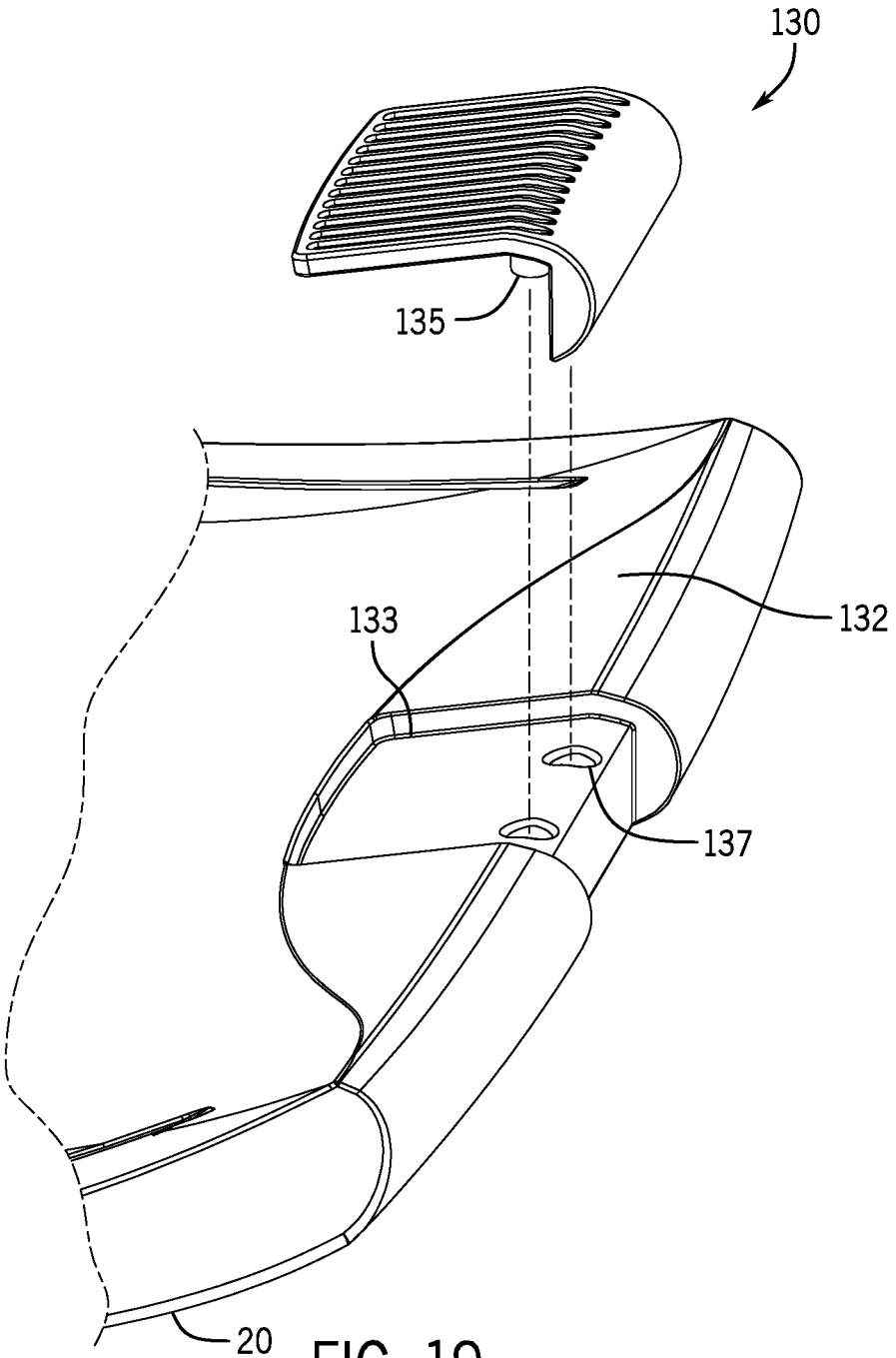
FIG. 19 a magnified, exploded view showing the separation of the seat glide cover from the seat.

Referring back to FIG. 8, when the backrest 14 is in the upright position and the seat assembly is in the retracted position, a contact block 126 formed on a lower portion 128 of the backrest 14 contacts a seat glide cover 130 mounted to the rear portion 132 of the seat 20. In the embodiment illustrated, the seat glide cover 130 is formed from a material that is different from the material used to form the seat 20. Specifically, as illustrated in FIG. 19, the seat glide cover 130 is a separate component that is received and retained within a recessed cavity 133 formed in the rear portion 132 of the seat. The seat glide cover 130 includes a pair of mounting posts 135 that are each received within an opening 137 formed in the recessed cavity 133. The interaction between the mounting posts and the openings 137 retains the seat glide cover 130 along the rear portion 132 of the seat 20.

The seat glide cover 130 is designed to be removable and replaced upon wear over extended use of the chair. In the embodiment illustrated, the seat glide cover 130 is formed from a material that is designed to reduce the amount of squeaking and noise during the interaction between the seat glide cover 130 and the contact block 126. For example, it is contemplated that the seat glide cover 130 could be formed from UHMW while the remaining portion of the seat 20 is formed from a thermoplastic material.

Figure 20:
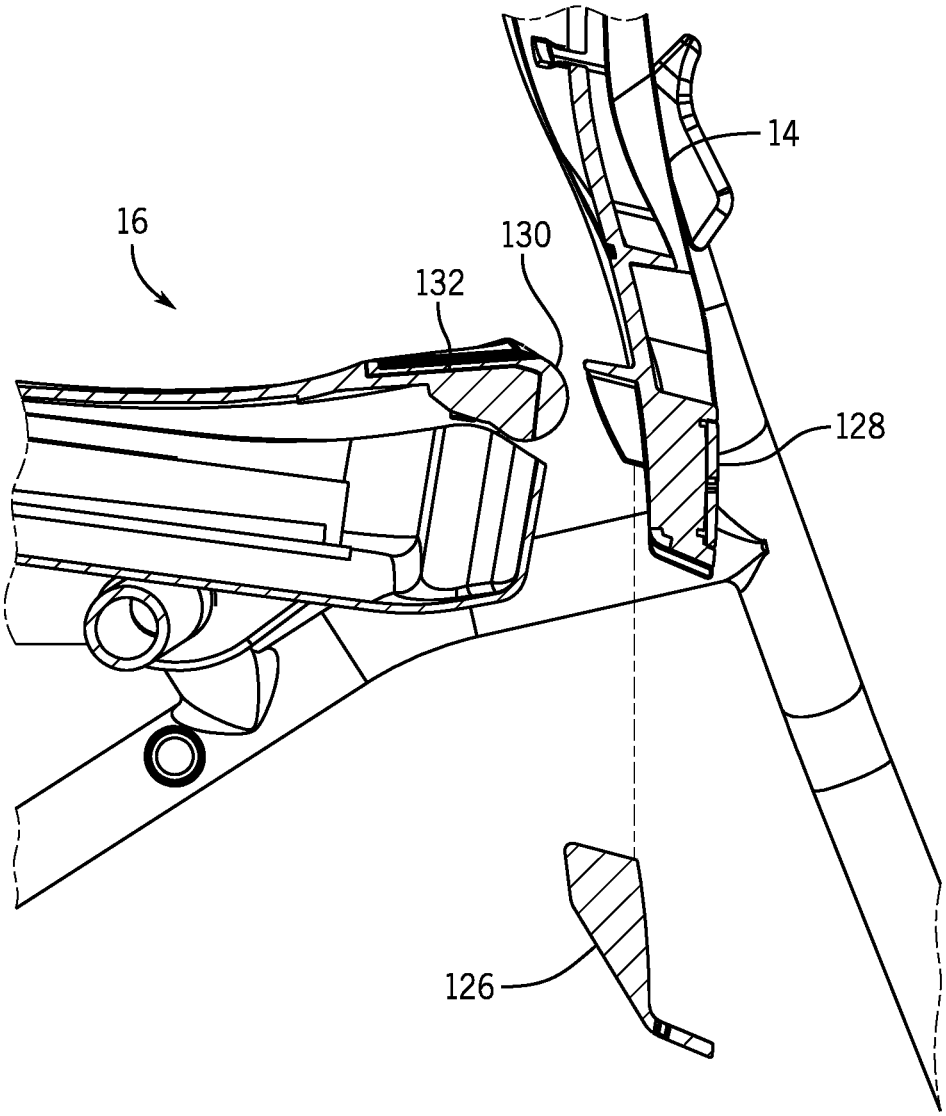
FIG. 20 is a magnified, exploded view showing the separation of the contact block from the backrest.
Figure 21:
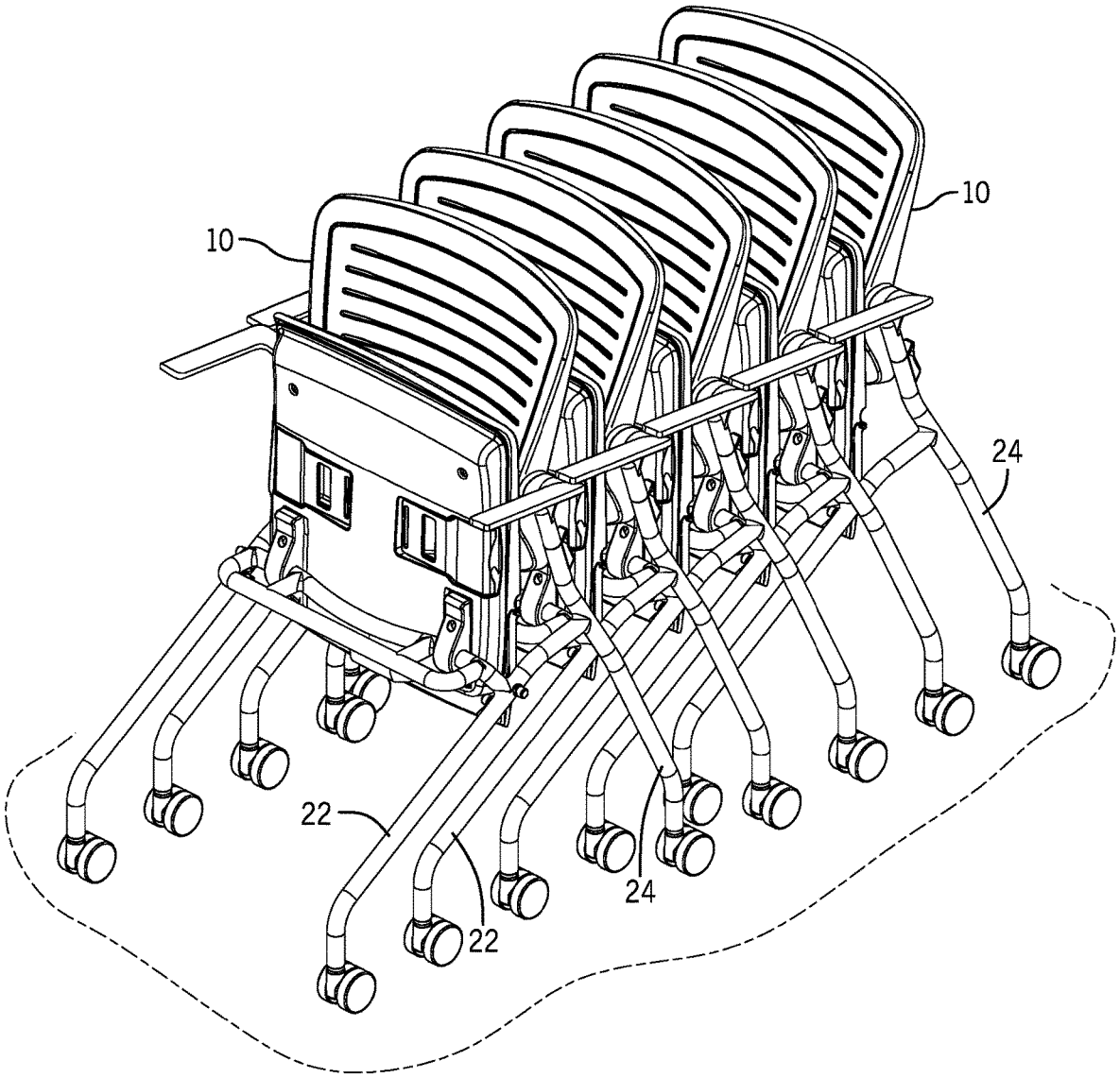
FIG. 21 is a view of multiple chairs in a nested condition, each with the seat assembly in the raised, nesting position.

In the embodiment illustrated in FIG. 20, the contact block 126 is formed as a separate component that can be removed from the remaining portions of the backrest 14. The contact block 126 is designed to be removable and replaced upon wear over extended use of the chair. In the embodiment illustrated, the contact block 126 is formed from a material that is designed to reduce the amount of squeaking and noise during the interaction between the seat glide cover 130 and the contact block 126. For example, it is contemplated that the contact block 126 could be formed from UHMW while the remaining portion of the backrest 14 is formed from a thermoplastic material.

As can be understood in FIGS. 12 and 13, as the backrest 14 pivots toward a reclined position, the lower portion 128 of the backrest 14 moves in the direction shown by arrow 134. During this forward movement, the backrest 14 pushes the seat 20 forward to the forward position shown in FIG. 13. During this movement, the seat glide cover 130 remains in constant contact with the outer surface of the contact block 126. As described previously, both the bias spring 94 and the torsion spring of the arm assembly provide an active bias force against the pivoting movement of the backrest 14 and the forward movement of the seat from the retracted position to the forward position. When the user no longer is seated on the chair, the combination of the bias spring 94 and the torsion spring work to return the backrest 14 and the seat assembly to the condition shown in FIG. 12.

Figure 14:
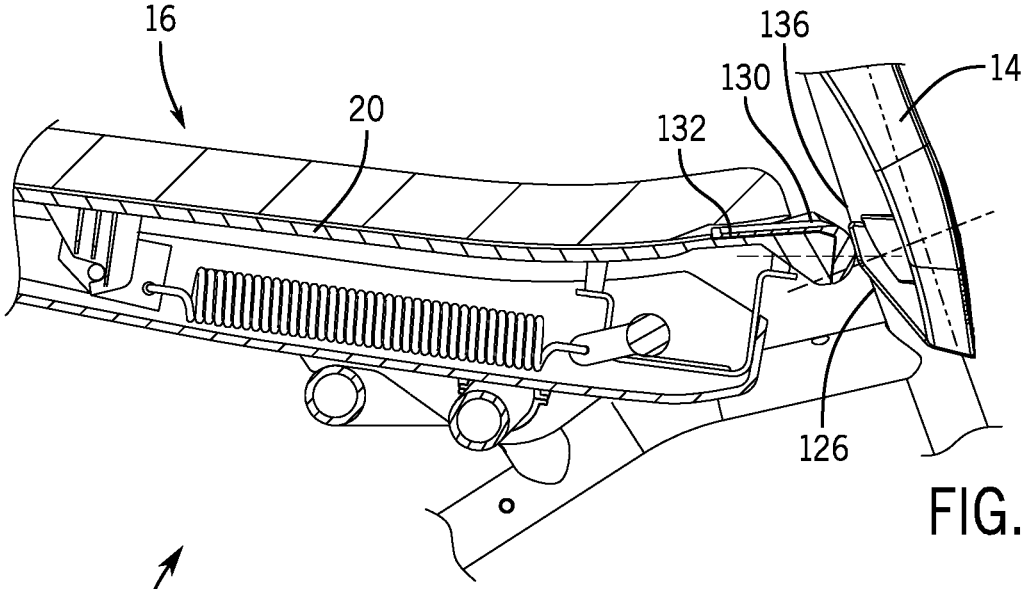
FIG. 14 is a section view showing the seat assembly in the retracted position and the backrest in the upright position.
Figure 15:
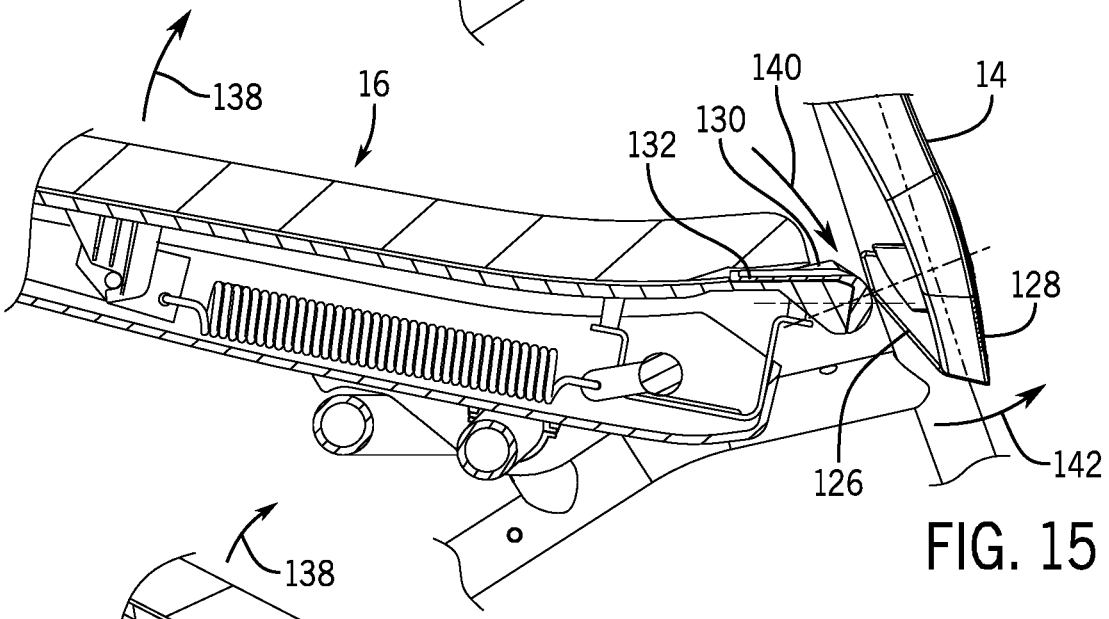
FIG. 15 is a section view showing the initial movement of the seat assembly toward the nesting position.
Figure 16:
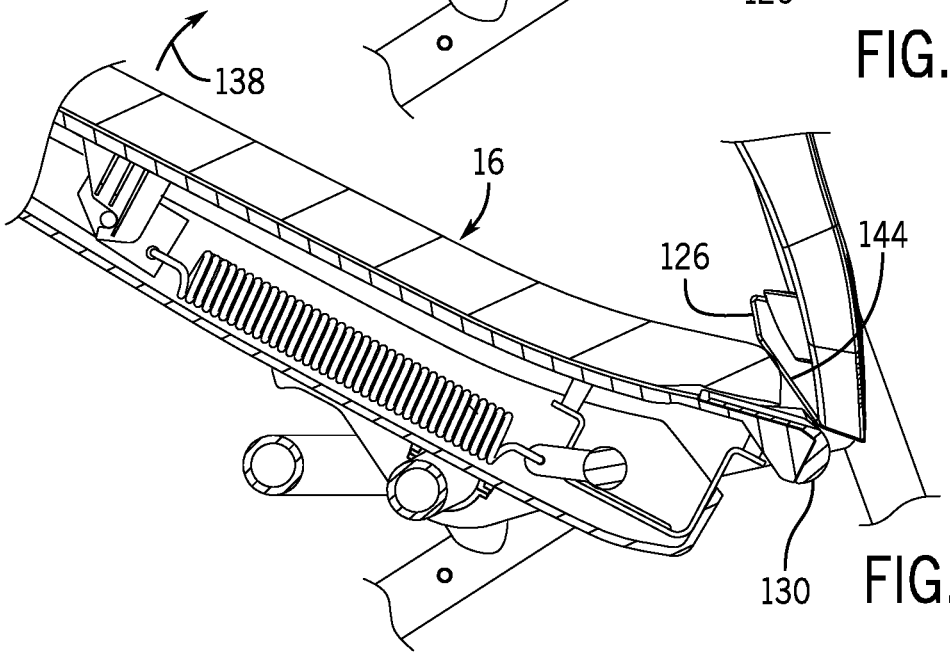
FIG. 16 shows additional movement of the seat assembly toward the nesting position.
Figure 17:
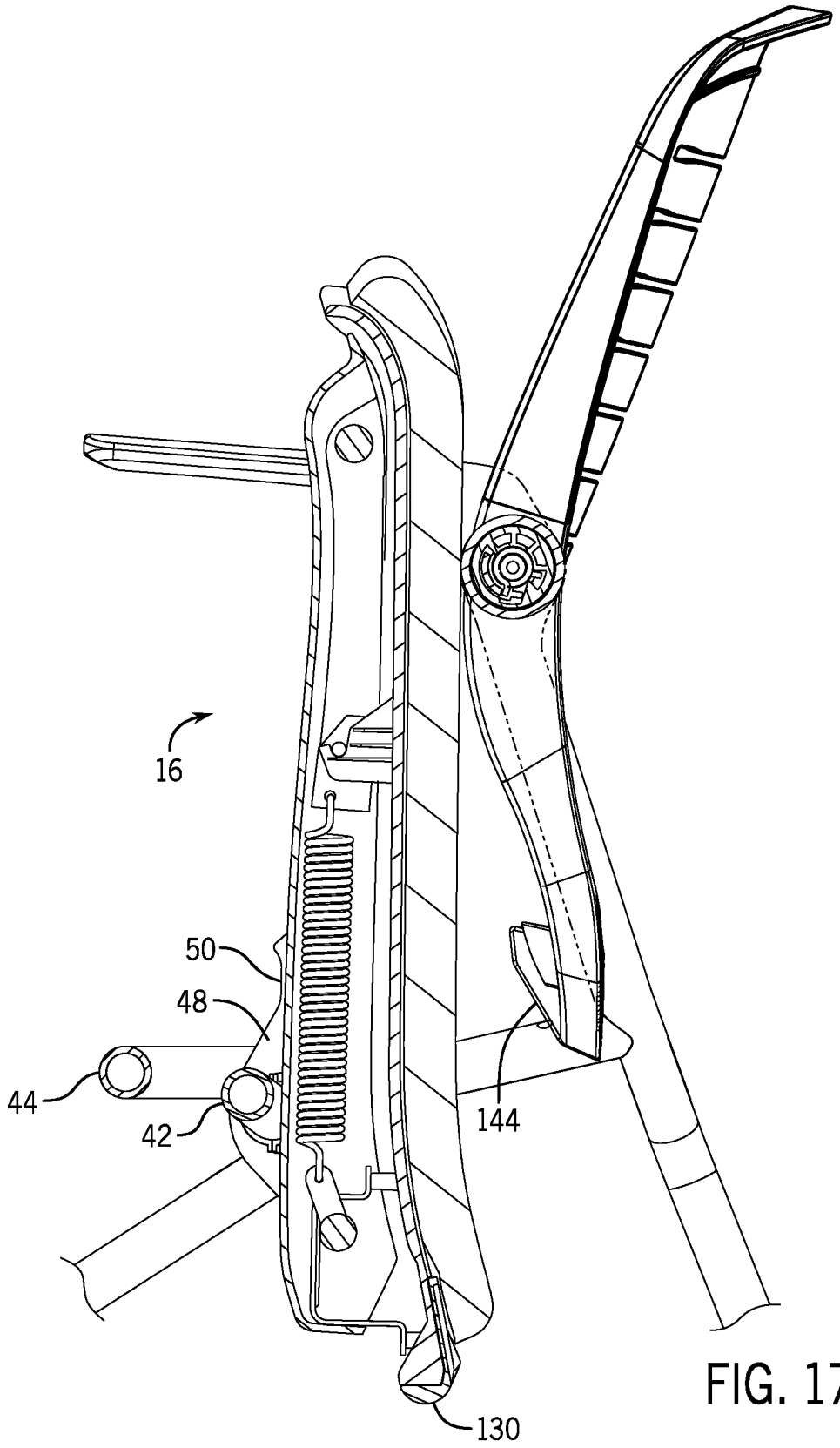
FIG. 17 is a side view showing the seat assembly in the fully raised, nesting position.

Referring now to FIGS. 14-17, the pivoting movement of the entire seat assembly 16 from the lowered, seating position shown in FIG. 14 to the fully raised, nesting position shown in FIG. 17 is illustrated.

Initially, when the seat assembly 16 is in the lowered, seating position and the seat 20 is fully retracted, the seat glide cover 130 on the rear portion 132 of the seat 20 is in contact with the upper portion 136 of the contact block 126. When the user decides to move the seat assembly from the lowered, seating position to the raised, nesting position, the user exerts an upward force on the seat assembly 16 as shown by arrow 138. During this upward movement, the rear portion 132 begins to move downward, as shown by arrow 140. At this same time, the contact between the seat glide cover 130 and the contact block 126 causes a slight rearward movement of the lower portion 128 of the backrest 14, as shown by arrow 142.

The continued upward movement of the seat assembly 16, as shown in FIG. 16, causes the seat glide cover 130 to pass over a sloped surface 144 on the contact block 126. The sloped surface 144 allows for free pivoting movement of the seat assembly 16 until the seat assembly 16 reaches the fully raised, nesting position shown in FIG. 17. In this fully raised, nesting position, multiple chairs 10 can be nested as shown in FIG. 21.

Figure 18:
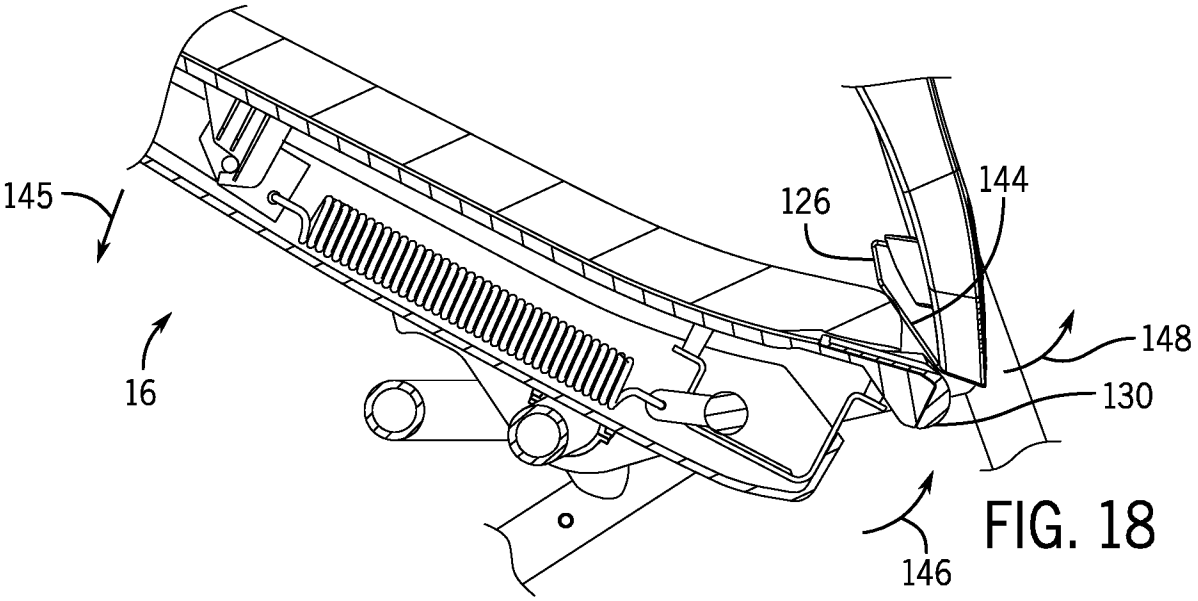
FIG. 18 is a side view showing the initial movement of the seat assembly from the raised, nesting position to the lowered, seating position.

When the user again desires to return the seat to the lowered, seating position from the raised, nesting position, the seat assembly 16 is pivoted downward until the rear glide cover 130 again engages the sloped surface 144 on the contact block 126, as shown in FIG. 18. During this downward pivoting movement shown by arrow 145, the seat glide cover 130 moves upward as shown by arrow 146. The seat glide cover continues to move upward and the contact between the seat glide cover 130 and the sloped surface 144 causes the backrest to pivot outward as shown by arrow 148. The seat glide cover 130 continues to move along the sloped surface 144 until the seat assembly 16 returns to the lowered, seating position shown in FIG. 14.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A chair comprising:

a support frame having a plurality of legs;

a seat assembly supported by the support frame, the seat assembly including a seat and a seat bottom cover, wherein the seat assembly is pivotably mounted to the support frame such that the seat assembly is configured to move between a lowered, seating position and a raised, nesting position;

a backrest movable between an upright position and a reclined position, wherein a lower portion of the backrest contacts a rear portion of the seat when the seat assembly is in the lowered position; and a pair of glide tracks supported by the support frame, wherein the seat is movable along the glide tracks between a forward position and a retracted position when the seat assembly is in the lowered position.

2. The chair of claim 1 wherein the lower portion pushes the seat into the forward position when the backrest moves from the upright position to the reclined position.

3. The chair of claim 2 further comprising a bias member connected to the seat to urge the seat into the retracted position.

4. The chair of claim 1 further comprising a seat glide cover mounted to the rear portion of the seat.

5. The chair of claim 4 wherein the seat glide cover is formed from a first material and the seat is formed from a second material different from the first material.

6. The chair of claim 4 wherein the lower portion of the backrest includes a contact block that engages the seat glide cover.

7. The chair of claim 6 wherein the contact block is formed from a first material and the backrest is formed from a second material different from the first material.

8. The chair of claim 1 wherein each of the glide tracks includes a movement slot that receives a stop member formed on the seat, wherein the movement slot limits lateral movement of the seat.

9. A chair comprising:

a support frame having a plurality of legs and at least one cross bar;

a seat assembly supported by the support frame, the seat assembly including a seat and a seat bottom cover, wherein the seat assembly is pivotably mounted to the support frame such that the seat assembly is configured to move between a lowered, seating position and a raised, nesting position;

a backrest movable between an upright position and a reclined position;

a pair of glide tracks supported by the support frame, wherein the seat is movable along the glide tracks between a forward position and a retracted position when the seat assembly is in the lowered position; and a seat frame sub-assembly including at least one pivot bracket connected to the at least one cross bar, wherein the seat assembly pivots about the at least one cross bar.

10. The chair of claim 9 wherein the seat frame sub-assembly includes the pair of glide tracks and two pivot brackets that are each connected to one of the pair of glide tracks.

11. The chair of claim 10 wherein the pair of glide tracks are joined to each other and located between the seat and the seat bottom cover.

12. A chair comprising:

a support frame having a plurality of legs and at least one cross bar;

a seat assembly rotatably mounted to the support frame and movable between a lowered, seating position and a raised, nesting position, the seat assembly including a seat and a seat frame sub-assembly, wherein the seat frame sub-assembly is pivotably mounted to the at least one cross bar and the seat is movable relative to the seat frame sub-assembly between a forward position and a retracted position when the seat assembly is in the lowered position; and a backrest pivotally connected between a pair of arm assemblies each connected to one of a pair of rear legs, wherein the backrest is separate from the seat assembly and a lower portion of the backrest contacts a rear portion of the seat when the seat assembly is in the lowered position, wherein the backrest is movable between an upright position and a reclined position.

13. The chair of claim 12 wherein the seat frame sub-assembly further comprises:

a pair of pivot brackets that each partially surround the at least one cross bar; and a pair of glide tracks each connected to one of the pivot brackets, wherein the seat is movable along the glide tracks.

14. The chair of claim 13 wherein the pair of glide tracks are joined to each other and are surrounded by a seat bottom cover.

15. The chair of claim 13 wherein each of the glide tracks includes a movement slot that receives a stop member formed on the seat, wherein the movement slot limits the lateral movement of the seat.

16. The chair of claim 12 wherein a lower portion of the backrest contacts a rear portion of the seat when the seat assembly is in the lowered position.

17. The chair of claim 16 wherein the lower portion of the backrest pushes the seat into the forward position when the backrest moves from the upright position to the reclined position.

18. The chair of claim 17 further comprising a bias member connected to the seat to urge the seat into the retracted position.

* * * * *